United States Patent [19]

Logic et al.

[11] Patent Number: 4,651,815

[45] Date of Patent: Mar. 24, 1987

[54] HEADER PLATE-TANK CONNECTION

[75] Inventors: Jeffrey A. Logic, Racine; Russell C. Awe, Brookfield; Norman F. Costello, Racine, all of Wis.; Zalman P. Saperstein, Gurnee, Ill.

[73] Assignee: Modine Manufacturing Company, Racine, Wis.

[21] Appl. No.: 746,445

[22] Filed: Jun. 19, 1985

[51] Int. Cl.[4] ..... F28F 9/02

[52] U.S. Cl. ..... 165/76; 165/148; 165/173

[58] Field of Search ..... 165/173, 148, 76, 149

[56] References Cited

U.S. PATENT DOCUMENTS

| | | | |
|---|---|---|---|
| 3,894,580 | 7/1975 | Chartet | 165/67 |
| 4,324,028 | 4/1982 | Severson | 165/171 X |
| 4,324,290 | 4/1982 | Moranne | 165/173 |
| 4,331,201 | 5/1982 | Hesse | 165/153 |
| 4,448,321 | 5/1984 | Hanlet | 220/4 R |
| 4,544,029 | 10/1985 | Cadars | 165/149 |

FOREIGN PATENT DOCUMENTS

| | | | |
|---|---|---|---|
| 0028951 | 5/1981 | European Pat. Off. | 165/76 |
| 2703528 | 8/1978 | Fed. Rep. of Germany | 165/76 |
| 3047411 | 7/1982 | Fed. Rep. of Germany | 165/76 |
| 3222301 | 12/1983 | Fed. Rep. of Germany | 165/76 |
| 3222300 | 12/1983 | Fed. Rep. of Germany | 165/76 |
| 2259344 | 8/1975 | France | 165/149 |
| 2422921 | 11/1979 | France | 165/149 |
| 1012002 | 4/1983 | U.S.S.R. | 165/76 |

*Primary Examiner*—Albert W. Davis, Jr.
*Assistant Examiner*—Randolph A. Smith
*Attorney, Agent, or Firm*—Wood, Dalton, Phillips, Mason & Rowe

[57] ABSTRACT

A tank-header connection including a groove extending about the periphery of a header plate and having a bottom wall surrounded by an upstanding wall with spaced apertures therein. A compressible gasket is located in the groove and a plastic tank having an opening surrounded by a rim is provided. The rim has a series of outwardly projecting lugs and is otherwise sized and configured to fit within the groove with the lugs extending through and being captured in aligned ones of the apertures.

11 Claims, 6 Drawing Figures

HEADER PLATE-TANK CONNECTION

FIELD OF THE INVENTION

This invention relates to heat exchangers of the type having a header plate supporting the open ends of a plurality of tubes and a tank secured to the header plate; and more specifically, to an improved connection between the tank and the header plate.

BACKGROUND OF THE INVENTION

Prior art of possible relevance includes the following U.S. Letters Pat. No.: 3,894,580 issued July 15, 1975 to Chartet; U.S. Pat. No. 4,324,028 issued Apr. 13, 1982 to Severson; U.S. Pat. No. 4,324,290 issued Apr. 13, 1982 to Moranne; U.S. Pat. No. 4,331,201 issued May 25, 1982 to Hesse; and U.S. Pat. No. 4,448,321 issued May 15, 1984 to Hanlet. Of the foregoing, the Hesse and Moranne patents have the most relevance.

The effort by the automotive industry to reduce the weight of vehicles to thereby improve mileage is seen in increasing use of non-metallic materials is various parts of vehicles. Heat exchangers, more commonly termed radiators, are no exception. While metal materials are still employed in the cores of such heat exchangers because of their greater thermal conductivity over other materials, other heat exchanger components that do not require good thermal conductivity are being made of plastic. A primary example is the so-called tanks which are fitted to the heat exchanger core most typically by securement to the header plates which define the ends of such cores.

Because the joint between the header plate and the tank is one of dissimilar materials, prior techniques of brazing or soldering the joints can no longer be employed. In lieu thereof, to effect the necessary seal, a gasket is disposed between the tank and the header plate and any of a variety of means are employed to hold the components in assembled relation with the gasket under compression to assure a seal at the operating pressure for which the heat exchanger was designed.

It is, of course, necessary that the means employed to effect the connection be strong and long lived to prevent leakage. At the same time, it is desirable that the means be such that disassembly of the component parts can be effected when required for serving. It is also desirable that the means utilized lend themselves to use in mass production to minimize cost.

Attempts to achieve these objects have resulted in proposals wherein a header plate is provided with a peripheral groove in which the gasket to be compressed may be disposed. The tank is provided with a peripheral flange sized to be wholly received in the groove and adapted to compress the gasket therein. The outer wall of the groove is then deformed in part to overlie the flange and the tank and hold the same in a position compressing the gasket. This approach is exemplified by the above identified Morrane and Hesse patents.

Unfortunately, because this approach involves deformation of a metal wall which necessarily may be sufficiently thin so as to be easily deformed, the same may not always be as strong as might be desired. Pressure within the system during operation will act against the deformed material and tend to deform it back toward the original configuration. When such occurs, the compressive forces exerted on the gasket are lessened and leakage may occur.

Moreover, these constructions require a relatively wide groove or recess to receive the entirety of the width of the flange. This results in a relatively long moment arm between the point of deformation of the outer groove wall over the flange and the point whereat the inner groove wall meets the header plate which increases the force concentration at the latter location.

Furthermore, the sealing methods employed in such constructions are totally dependent upon the degree of compressive force maintained on the seal by the tank-header plate connection. Consequently, lessening of this force lowers the efficiency of the seal.

In addition, because these constructions require deformation of the flange after the tank is assembled thereto, the assembly process is undesirably expensive in view of the need for fixtures and specialized tooling to provide deformation of the flange.

The present invention is directed to overcoming one or more of the above problems.

SUMMARY OF THE INVENTION

It is a principal object of the invention to provide a new and improved header-tank connection. More specifically, it is an object of the invention to provide a connection wherein stress concentrations are minimized, wherein sealing is not totally dependent upon mechanical connections, and wherein the process of assembling the tank to the header plate can be considerably simplified.

According to the invention, there is provided a metal header plate supporting the open ends of a plurality of tubes. A groove extends around the periphery of the header plate and has a bottom wall surrounded by an upstanding wall which in turn has spaced apertures therein. A compressible gasket is located in the groove and a plastic tank having an opening surrounded by a rim is employed. The rim has a series of outwardly projecting lugs and is otherwise sized and configured to be fitted within the groove with the lugs extending through and being captured in aligned ones of the apertures with the tank compressing the gasket so that the gasket effects a seal between the tank and the header plate.

In a preferred embodiment, the sides of the lugs facing the walls have cam surfaces for camming the upstanding wall away from the header plate to allow the rim to enter the groove and the lugs to enter the apertures.

In a highly preferred embodiment, the sides of the lugs opposite the bottom wall have retaining formations for retaining parts of the upstanding walls which define boundaries of the apertures. The retaining formations are in interference fit with such sides of the lugs.

According to the invention, the retaining formations may be slightly concave surfaces.

In its best mode, the invention contemplates that the rim have a tapered surface inwardly of the tank which is at least partially within the groove. The gasket is in sealing engagement with such tapered surface and is exposed to the interior of the tank so as to be subjected to pressurized fluid therein.

In a modified embodiment of the invention, the cam surface may be located on the upper edge of the upstanding wall rather than on the side of the lug facing the bottom of the groove.

Other objects and advantages will become apparent from the following specification taken in connection with the accompanying drawings.

DESCRIPTION OF THE PREFERRED EMBODIMENT

Figure 1:
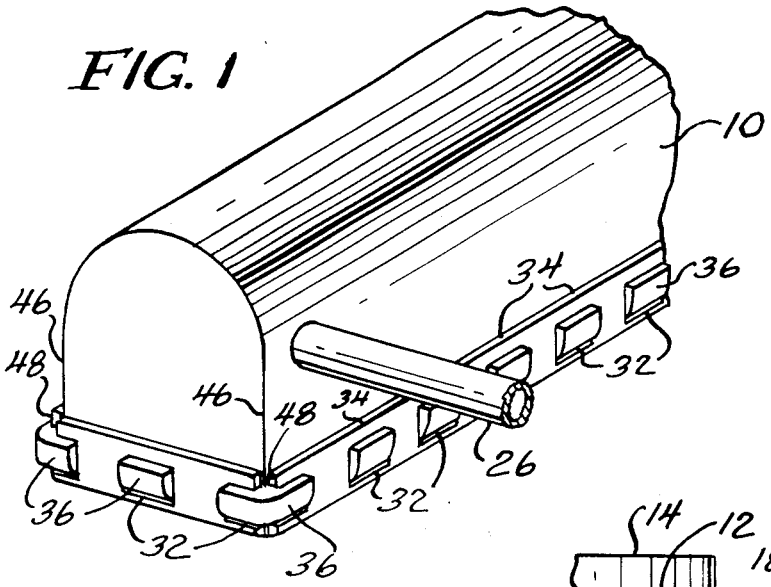
FIG. 1 is a somewhat fragmentary, perspective view of a tank and header plate assembly made according to the invention.
Figure 2:
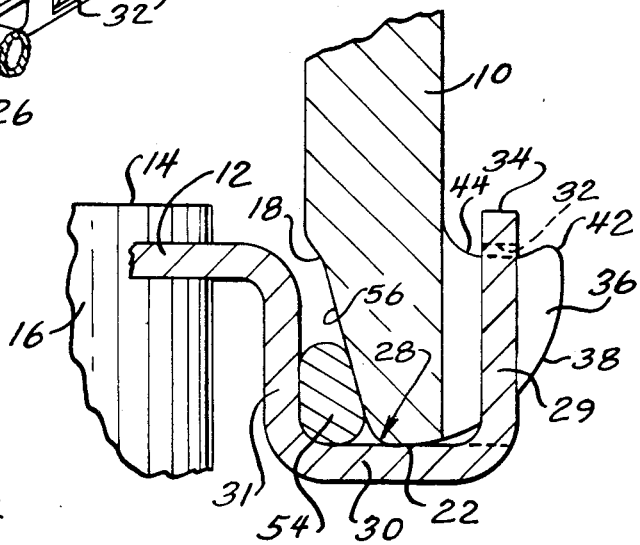
FIG. 2 is an enlarged, vertical section of one embodiment of a connection made according to the invention.

One exemplary embodiment of the invention is illustrated in FIGS. 1 and 2 of the drawings and is seen to include a radiator tank 10, typically formed of plastic and a header plate 12 formed of metal. Conventionally, the header plate 12 receives the open ends 14 of a plurality of tubes 16 (only one of which is shown). The tubes 16 will typically be of brass, copper or aluminum or other metal of good thermal conductivity.

The tank 10 has an opening 18 which is surrounded by a rim 22. One or more coolant ports 26 are in fluid communication with the interior of the tank 10. As best seen in FIG. 2, the header plate 12 includes a peripheral groove generally designated 28. The groove is defined by an upstanding outer wall 29, a bottom wall 30 and an inner wall 31 which merges with the main body of the header plate 12 by means of a round. In other words, according to the invention, all components of the groove 28 are integral with the header plate 12 and are typically formed therein by a stamping operation.

As can be seen in FIGS. 1 and 2, the outer wall 29 is provided with a plurality of apertures 32. As can be seen from FIGS. 1 and 2, for the orientation of the assembly as shown therein, the upper boundry of each aperture 32 is generally defined by a continuous portion 34 of the outer wall 29.

Extending outwardly from the rim 22 are a plurality of lugs 36 formed integrally and immovably on the tank 10 as by a conventional molding process. The lugs 36 are spaced corresponding to the spacing between the apertures 32 and are aligned therewith. The same are such as to extend through the corresponding apertures 32 as seen in FIGS. 1 and 2 whereby the tank 10 is captured within the groove 28 and assembled to the header plate 12.

Figure 4:
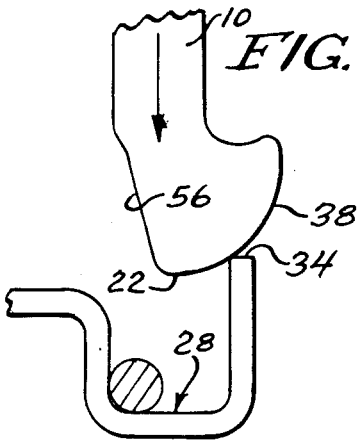
FIG. 4 is a somewhat schematic view of an early stage in the process of assemblying a tank to a header plate according to the invention.
Figure 5:
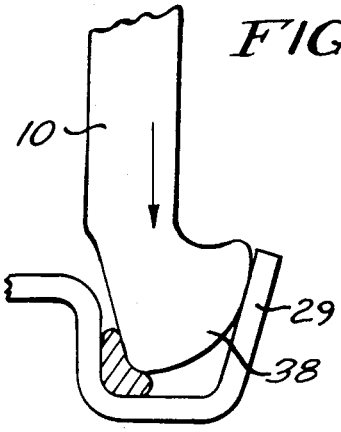
FIG. 5 is a view similar to FIG. 4 but at an intermediate stage in the assembly process.
Figure 6:
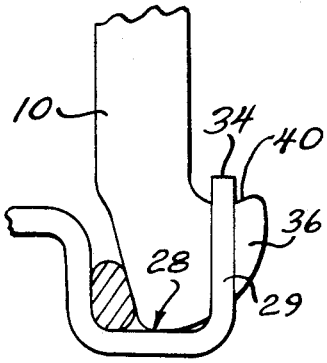
FIG. 6 is a view similar to FIGS. 4 and 5 but showing the final stage of the process.

In the embodiment illustrated in FIGS. 1, 2 and 4–6, to facilitate assembly of the tank 10 to the header plate 12, the side 38 of each lug 36 is rounded so as to essentially define a cam surface. As can be seen in FIGS. 4–6, when, during the assembly process, the tank 10 is moved downwardly with the rim 22 aligned with the groove 28, the cam surface 38 on each lug will engage the corresponding continuous portion 34 of the upstanding wall 30 for the corresponding aperture 32. This relationship is illustrated in FIG. 4. Continued downward movement of the tank 10 will result in the tank walls deflecting somewhat to the left as viewed in FIG. 5 while the outer wall 29 will deflect to the right by reason of the camming action. This is illustrated in FIG. 5.

When the tank 10 has fully entered the groove 28 as illustrated in FIG. 6, the upper side 40 of each of the lugs 36 will be just even with or slightly below the upper edge of the corresponding aperture 32 and the inherent resilience of the components will allow the tank 10 to return to its original configuration as will the outer wall 29 bringing the continuous portion 34 into overlying relation with the upper sides 40 of the lugs 36. This essentially establishes an interference fit which may be enhanced by the provision of retaining formations in the form of noses 42 on the outermost part of the upper side 40 of the lugs 36. The retaining noses 42 serve to define concave surfaces 44 on each of the lugs 36 on the upper sides 40 thereof.

In some instances, where the material of which the outer wall 29 is made is of relatively low resilience or is sufficiently thin so as to easily deform, external means may be employed to return the outer wall 29 to the position illustrated in FIGS. 1, 2 and 6.

In the usual case, the header plate 12 will be generally rectangular as is apparent from FIG. 1 and as a result, corners 46 will be present in all parts of the header plate 12 including the upstanding wall 30. Where lugs 36 are located at the corners 46 of the tank 10, the outer wall 29 will be slotted as at 48 at such corners so as to allow each of the individual portions of the outer wall 29 to deflect without being resisted by hoop strength.

Figure 3:
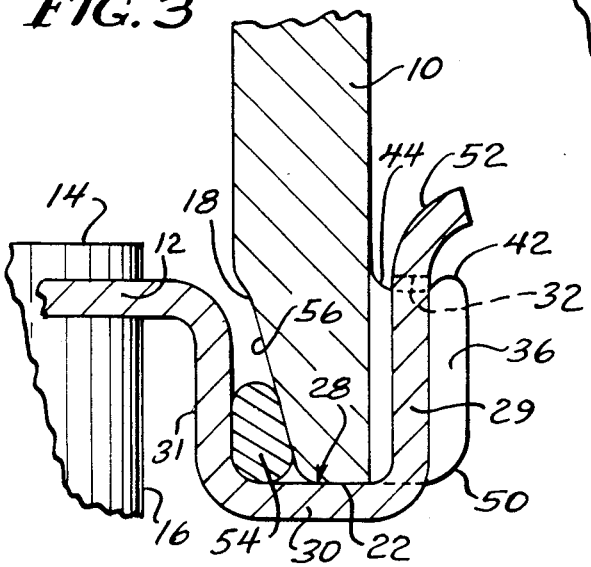
FIG. 3 is a view similar to FIG. 2 but showing another embodiment of the invention.

A modified embodiment is illustrated in FIG. 3 and in this case, the cam surface 50 on each lug 36 is less rounded than the cam surface 38. To provide the requisite camming action, the upper edge 52 of the outer wall 29 may be curved away from the tank 10 to thereby define a cam surface on the upper edge 52 of the outer wall 29. In this embodiment, the cam surfaces 50 and 52 coact to provide the necessary camming action depicted in FIGS. 4–6 respectively. In some instances, if the cam surface defined by the curved upper edge 52 is sufficiently generous, the cam surface 50 may be omitted entirely.

To provide sealing, an elastomeric gasket 54 is disposed in the groove 28 and the inner side of the rim 22 provided with a flared or tapered surface 56. The flared surface 56 not only prevents interference between the interior wall of the tank 10 with the side wall 34 or round 36 during the assembly process, but serves to effect a better seal than obtained in prior art constructions wherein the seal is compressed by the underside of a flange solely against a bottom of a groove. In particular, because of the tapered or flared surface 56, the gasket compressingly abuts the inner side of the side wall 31, the inner portion of the bottom wall 32 and the flared surface 56; and is so located as to be exposed to pressurized fluid within the tank 10. As can be appreciated from the drawings, such fluid under pressure will tend to force the gasket downwardly within the groove 28 but since the gasket 54 is in abutment with the bottom wall 30 of the groove 28, it cannot move downwardly. As a result, such pressure tends to cause the gasket 54 to bear with increased force proportional to the pressure of the fluid, against both the inner side wall 31 and the flared surface 40 as well as the bottom wall 30 to increase and enhance the sealing engagement between the components.

From the foregoing, it will be appreciated that a tank-header assembly connection made according to the invention provides improved strength over prior art connections since permanent deformation of outer wall 29 is not required to restrain the lugs 36 and maintain the assembly in assembled relation. Furthermore, enhanced sealing is obtained as mentioned immediately preceding and considerable assembly process economies are garnered as a consequence of avoiding any need for special fixtures and forming processing required to deform groove walls after the components are in assembled relation.

What is claimed is:

1. A connection for securing a tank to a header plate in a heat exchanger comprising:
   - a metal header plate supporting the open ends of a plurality of tubes;
   - a groove extending about the periphery of said header plate and having a bottom wall surrounded by an upstanding wall having spaced apertures therein;
   - a compressible gasket in said groove; and
   - a plastic tank having an opening surrounded by a rim with outwardly projecting, immovable lugs and otherwise being sized and configured to be fitted within said groove with said lugs extending through and being captured in aligned ones of said apertures, said tank compressing said gasket so that said gasket effects a seal between said tank and said header plate.

2. The connection of claim 1 wherein said rim includes a tapered surface inwardly of said tank and at least partially within said groove, said gasket being in sealing engagement with said tapered surface and exposed to the interior of said tank so as to be subjected to pressurized fluid therein.

3. The connection of claim 1 wherein at least one of the sides of said lugs facing said walls and the edge of said upstanding wall have cam surfaces for camming said upstanding wall away from said header plate to allow said lugs to enter said apertures.

4. The connection of claim 1 wherein the sides of said lugs opposite said bottom wall have concave formations receiving parts of said upstanding wall defining boundaries of said apertures.

5. The connection of claim 1 wherein said plate, said groove and said walls are generally rectangular to define corners in each, there being apertures in at least some of the corners of said upstanding walls, the remainders of said some corners being slotted.

6. The connection of claim 1 wherein the sides of said lugs opposite said bottom wall have retaining formations for retaining parts of said upstanding wall defining boundaries of said apertures in interference relation with said sides.

7. A connection for securing a tank to a header plate in a heat exchanger comprising:
   - a metal header plate supporting the open ends of a plurality of tubes;
   - a groove extending about the periphery of said header plate and having a side wall extending from said header plate to a bottom wall which is in turn surrounded by an upstanding wall having a plurality of apertures therein;
   - a compressible gasket in said groove;
   - a plastic tank having an opening surrounded by a rim sized and configured to be fitted within said groove and having a tapered inner surface adjacent said opening and abutting said gasket compressing said gasket against said side wall so that said gasket effects a continuous seal between said tank and said side wall; and
   - a plurality of lugs on said rim and directed away from said opening, said lugs being aligned with and received within corresponding ones of said apertures to be captured therein to hold said tank rim within said groove in compressing relation to said gasket.

8. The connection of claim 7 wherein at least one of the sides of said lugs facing said walls and the edge of said upstanding wall have cam surfaces for camming said upstanding wall away from said header plate to allow said lugs to enter said apertures.

9. The connection of claim 7 wherein the sides of said lugs opposite said bottom wall have retaining formations for retaining parts of said upstanding wall defining boundaries of said apertures in interference relation with said sides.

10. The connection of claim 7 wherein said plate, said groove and said walls are generally rectangular to define corners in each, there being apertures in at least some of the corners of said upstanding walls, the remainders of said some corners being slotted.

11. A connection for securing a tank to a header plate in a heat exchanger comprising:
   - a metal header plate supporting the open ends of a plurality of tubes;
   - a groove extending about the periphery of said header plate and having a bottom wall surrounded by an upstanding wall having spaced apertures therein;
   - a compressible gasket in said groove; and
   - a plastic tank having an opening surrounded by a rim, said rim having a series of immovable outwardly extending spaced lugs and otherwise being sized and configured to be fitted within said groove with said lugs extending through aligned ones of said apertures, said lugs being rounded on their sides facing said walls and being slightly convex oppositely thereof to be in an interference fit with parts of said apertures, said tank compressing said gasket so that said gasket effects a seal between said tank and said header plate.

* * * * *